US008959931B2

(12) United States Patent
Mathews et al.

(10) Patent No.: US 8,959,931 B2
(45) Date of Patent: Feb. 24, 2015

(54) TRANSPORTING AND MANAGING LIQUEFIED NATURAL GAS

(75) Inventors: William S. Mathews, The Woodlands, TX (US); Mark E. Ehrhardt, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 1004 days.

(21) Appl. No.: 12/375,926

(22) PCT Filed: Jul. 23, 2007

(86) PCT No.: PCT/US2007/016547

§ 371 (c)(1),
(2), (4) Date: Jun. 22, 2009

(87) PCT Pub. No.: WO2008/033183

PCT Pub. Date: Mar. 20, 2008

(65) Prior Publication Data

US 2009/0272126 A1 Nov. 5, 2009

Related U.S. Application Data

(60) Provisional application No. 60/843,658, filed on Sep. 11, 2006.

(51) Int. Cl.
*B63B 25/02* (2006.01)
*B63B 25/08* (2006.01)
(Continued)

(52) U.S. Cl.
CPC ..... *F17C 9/02* (2013.01); *F17C 2221/013* (2013.01); *F17C 2221/017* (2013.01);
(Continued)

(58) Field of Classification Search
USPC ..... 62/50.2, 53.2, 114, 240; 114/73, 74 R, 114/230.13
See application file for complete search history.

(56) References Cited

U.S. PATENT DOCUMENTS 3,590,407 A 7/1971 Bratianu
3,766,583 A 10/1973 Phelps
(Continued)

FOREIGN PATENT DOCUMENTS

EP 1 383 676 B1 1/2004
WO WO 98/59085 A1 12/1998
(Continued)

OTHER PUBLICATIONS

Harland, L. et al., "The Application of the FSRU for LNG Imports", GPA Europe Conference, Sep. 2003, 19 pages.
(Continued)

*Primary Examiner* — Marc Norman
*Assistant Examiner* — Jon T Schermerhorn
(74) *Attorney, Agent, or Firm* — ExxonMobil Upstream Research Company Law Department

(57) ABSTRACT

The present application is directed to methods and systems for transporting or importing LNG via vessels. Under the present techniques, SRTs, which are equipped with regasification equipment, LNG offloading equipment (e.g. marinized mechanical loading arms), LNG storage tanks, and equipment to transfer natural gas to an import terminal are utilized as temporary interchangeable FSRUs (TIFs). Two or more TIFs in conjunction with transport vessels (e.g. LNGCs) are utilized to transfer LNG between an export terminal and an import terminal. A first of the TIFs is utilized at an import terminal to offload LNG from LNGCs, while the second of the TIFs is utilized as a LNGC, carrying LNG between the export terminal and import terminal. The first of the TIFs may be replaced by the second of the TIFs to maintain operations for the import terminal. The use of multiple TIFs in combination with LNGCs provides an alterative LNG delivery approach in comparison to having a permanently moored FSRU located at the import terminal or using a fleet of SRT vessels to transport LNG between an export terminal and an import terminal.

13 Claims, 3 Drawing Sheets

(51) Int. Cl.

| | |
|---|---|
| ***B63B 22/02*** | (2006.01) |
| ***F17C 9/02*** | (2006.01) |
| ***F17C 13/08*** | (2006.01) |

(52) U.S. Cl.

CPC .. *F17C 2221/033* (2013.01); *F17C 2223/0161* (2013.01); *F17C 2223/033* (2013.01); *F17C 2223/046* (2013.01); *F17C 2225/0123* (2013.01); *F17C 2225/0161* (2013.01); *F17C 2225/033* (2013.01); *F17C 2225/035* (2013.01); *F17C 2227/0302* (2013.01); *F17C 2227/0393* (2013.01); *F17C 2250/01* (2013.01); *F17C 2260/048* (2013.01); *F17C 2265/05* (2013.01); *F17C 2270/0105* (2013.01)

USPC ..... 62/50.2; 62/53.2; 114/230.13; 114/74 R

(56) References Cited

U.S. PATENT DOCUMENTS

| | | | | |
|---|---|---|---|---|
| 4,207,827 | A * | 6/1980 | Gondouin | 114/74 A |
| 5,501,625 | A | 3/1996 | Belinsky | |
| 5,549,164 | A | 8/1996 | Blandford | |
| 6,003,603 | A | 12/1999 | Breivik et al. | |
| 6,089,022 | A | 7/2000 | Zednik et al. | |
| 6,164,247 | A | 12/2000 | Iwasaki et al. | |
| 6,298,671 | B1 | 10/2001 | Kennelley et al. | |
| 6,546,739 | B2 * | 4/2003 | Frimm et al. | 62/50.2 |
| 6,578,366 | B1 | 6/2003 | Christiansen et al. | |
| 6,598,408 | B1 | 7/2003 | Nierenberg | |
| 6,637,479 | B1 | 10/2003 | Eide et al. | |
| 6,673,249 | B2 * | 1/2004 | Max | 210/747.5 |
| 6,786,166 | B1 | 9/2004 | Marchand et al. | |
| 6,923,225 | B2 | 8/2005 | Poldervaart et al. | |
| 7,080,673 | B2 | 7/2006 | Pollack | |
| 7,107,925 | B2 | 9/2006 | Wille et al. | |
| 2002/0073619 | A1 | 6/2002 | Perkins et al. | |
| 2002/0134455 | A1 | 9/2002 | Emblem et al. | |
| 2002/0174662 | A1 | 11/2002 | Frimm et al. | |
| 2003/0182948 | A1 * | 10/2003 | Nierenberg | 62/50.2 |
| 2004/0045490 | A1 | 3/2004 | Goldbach | |
| 2004/0187385 | A1 | 9/2004 | Perkins et al. | |
| 2006/0010911 | A1 | 1/2006 | Hubbard et al. | |
| 2006/0156744 | A1 | 7/2006 | Cusiter et al. | |
| 2008/0011357 | A1 | 1/2008 | Wille et al. | |

FOREIGN PATENT DOCUMENTS

| | | | |
|---|---|---|---|
| WO | WO 01/03793 | A1 | 1/2001 |
| WO | WO 03/072993 | A1 | 9/2003 |
| WO | WO 2004/031644 | A1 | 4/2004 |
| WO | WO 2004/097285 | A1 | 11/2004 |
| WO | WO 2005/105565 | A1 | 11/2005 |
| WO | WO 2006/044053 | A1 | 4/2006 |
| WO | WO 2006044053 | A1 * | 4/2006 |
| WO | WO 2006/087330 | A2 | 8/2006 |
| WO | WO 2006/087331 | A1 | 8/2006 |
| WO | WO 2006/087332 | A1 | 8/2006 |
| WO | WO 2006/087452 | A1 | 8/2006 |
| WO | WO 2006/087520 | A1 | 8/2006 |
| WO | WO 2006/088371 | A1 | 8/2006 |
| WO | WO 2006/089042 | A2 | 8/2006 |

OTHER PUBLICATIONS

Larsen, O. B. et al., "SRV—the LNG Shuttle and Regas Vessel System", OTC 16580, Offshore Technology Conference, May 3-6, 2004, 4 pages, Houston, TX.

LNG Tanker Market Report, *DVB Research & Strategic Planning*, Jun. 2003, p. 160.

Loez, B., "New Technical and Economic Aspects of LNG Terminals", *Petrole Informations*, Aug. 1987, pp. 85-86.

Miller, R. et al., "Design of a Floating Storage and Regasification Unit (FSRU) for Offshore West Africa", OCEN 407—Design of Ocean Engineering Facility, Ocean Engineering Program, Texas A&M University, May 2004, pp. 1-4, 24-63.

"Offshore LNG Terminal Study", California Coastal Commission, Sep. 15, 1978, 49 pages.

Powers, B. et al., "Assessment of Potential Risk Associated with Location of LNG Receiving Terminal Adjacent to Bajamar and Feasible Alternative Locations", Report prepared for Bajamar Real Estate Services, S.A. de C.V., Bajamar, El Sauzal, Jun. 30, 2002, 24 pages, Baja California, MX.

Stohle, S., "The Case for Developing a Floating LNG Receiving Terminal on the US East Coast", LNG 2002, Feb. 6-7, 2002, 33 pages, Houston, TX.

Tatge, R. et al., "The Evaluation of Proposed Offshore LNG Receiving Terminals", OTC 3248,Offshore Technology Conference, May 8-11, 1978, pp. 1689-1696, Houston, TX.

Van Wijngmrden, W., "LNG Import—The Design of a 250,000-$M^3$ Floating Storage & Regasification Unit (FSRU)", IBC Global Conference, Houston, Texas, Jun. 16-17, 2003, 24 pages, PowerPoint presentation.

Van Wijngaarden, W. et al., "Loading and Offloading of LNG in Open Seas", Gastech 2002, Oct. 13-16, 2002, 10 pages, Doha, Qatar.

Van Wijngaarden, W. et al., "Tandem Offloading from an FLNG Barge", Gastech, 2002, Oct. 13-16, 2002, 33 pages, Doha, Qatar.

Wayne, W. et al., "Modification of LNG Carriers for Regasification", OTC 15230, 2003 Offshore Technology Conference, May 5-8, 2003, 7 pages, Houston, TX.

Zubiate, R. et al., "Single Point Mooring System for Floating LNG Plant", *Ocean Industry*, Nov. 1978, pp. 75-78.

European Search Report No. 114506, Jun. 13, 2007, for 2006EM105, 4 pages.

Aoki, E., "Technological Innovation of SPB Floating Terminal", Gastech 1998, 18$^{th}$ Annual LNG, LPG and Natural Gas Conference, Nov. 29-Dec. 2, 1998, 14 pages, Dubai.

BHP Billiton Petroleum, Inc., Press Release, "New Offshore LNG Facility Proposed to Meet Clean Energy Needs—Offshore Facility Ensures Coastal Protection and Public Safety", Aug. 15, 2003, 2 pages.

BHP Billiton Petroleum, Inc. Press Release, "plans to construct and operate Cabrillo Port, a floating LNG terminal", *Oil & Gas Journal*, Aug. 25, 2003, p. 9.

BHP Billiton Petroleum, Inc. Press Release, BHP Billiton Files Applications for Deepwater Port; Offshore Pipeline, Sep. 5, 2003, 1 page.

Broadwater Energy, Press Release for the Riverhead Town Board, "Summary of the Process to Select a Proposed Site for the Broadwater Energy Floating Storage and Regasification Unit", Dec. 16, 2004, 6 pages.

Buchanan, R. et al., "Techno-Economic Case for Offshore LNG", OTC 6081, Offshore Technology Conference, May 1-4, 1989, pp. 373-384, Houston, TX.

Chan, A. et al, "Evaluation of Liquefied Natural Gas Receiving Terminals for Southern California", University of California, Santa Barbara, Group Project for Master's degree, Apr. 2004, pp. i-xvi, 1-2, 12-15, 33-35, 64-65, 92-94.

De Baan, J. et al., "Offshore Transfer, Re-Gasification and Salt Dome Storage of LNG", OTC 15301, Offshore Technology Conference, May 5-8, 2003, pp. 1-14, Houston, TX.

De Deserts, L. et al., "Gravity base structure of a floating unit: What is the best solution for an offshore import terminal?", Gastech 1996, 17th Annual LNG, LPG and Natural Gas Conference, Dec. 3-6, 1996, 17 pages, Vienna, Austria.

Deybach, F. et al., "Membrane Technology for Offshore LNG", OTC 15231, Offshore Technology Conference, May 5-8, 2003, pp. 1-6, Houston, TX.

Dogliani, M., "Safety Assessment of LNG Offshore Storage and Regasification Unit", GASTECH 2002, 20$^{th}$ Oct. 13-16, 2002, 28 pages, Doha, Qatar.

"Final Report Evaluating and Ranking LNG Terminal Sites", California Coastal Commission, May 1978, 37 pages.

(56) References Cited

OTHER PUBLICATIONS

Fincantieri, G. et al., "LNG Receiving Terminal: The Floating Alternative", Gastech 2000, 19th Annual LNG, LPG and Natural Gas Conference Nov. 14-17, 2000, 10 pages, Houston, TX.
Finn, A., "New FPSO design produces LNG from offshore sources", *Oil & Gas Journal*, Aug. 26, 2002, pp. 56-62.
Garbuglia, E. et al., "LNG Floating Terminal: A viable safe solution for LNG Import", 17th International Conference on Offshore Mechanics and Arctic Engineering, Jul. 7, 1998, 13 pages.
Han, H. et al., "Design Development of FSRU from LNG Carrer and FPSO Construction Experiences", OTC 14098, 2002 Offshore Technology Conference, May 6-9, 2002, 8 pages, Houston, TX.

* cited by examiner

TRANSPORTING AND MANAGING LIQUEFIED NATURAL GAS

CROSS REFERENCE TO RELATED APPLICATIONS

This application is the National Stage of International Application No. PCT/US07/16547, filed 23 Jul. 2007, which claims the benefit of U.S. Provisional Application No. 60/843,658, filed 11 Sep. 2006.

FIELD OF THE INVENTION

This invention relates generally to a method of transferring fluids. In particular, the method and system relate to delivery of cargo, such as liquefied natural gas (LNG), via vessels between export and import terminals in various markets throughout the world.

BACKGROUND

This section is intended to introduce the reader to various aspects of art, which may be associated with exemplary embodiments of the present invention, which are described and/or claimed below. This discussion is believed to be helpful in providing the reader with information to facilitate a better understanding of particular techniques of the present invention. Accordingly, it should be understood that these statements are to be read in this light, and not necessarily as admissions of prior art.

Cargo is generally transferred from one port location to another port location by vessels, such as carriers. These carriers have propulsion and navigation systems for movement across large bodies of water, which may be referred to as open seas. In addition, the carriers may include accommodations for marine operations, storage tanks for liquid cargo and bays for solid cargo. With some carriers, special equipment and systems may be installed to assist with the transport of specific cargo. As such, carriers include equipment and systems to economically transfer cargo between market locations.

For instance, after natural gas is produced, it is processed and may be liquefied at export terminals or other facilities to convert it into LNG. LNG is the basis of a delivery technology that allows remote natural gas resources to be economically delivered to the market. The LNG is shipped to market in specially-designed LNG carriers (LNGCs) that are configured to store and transport the LNG across the large bodies of water. Then, the LNG is converted back into natural gas at an import terminal near the market location. Typically, the import terminals are located onshore or offshore near a port location. Regardless, the import terminal is connected through a pipeline to onshore equipment for further processing and/or distribution of the natural gas.

Offshore import or export terminals may be beneficial because they do not utilize onshore property, which may reduce some security concerns. However, significant technical challenges need to be addressed to successfully implement offshore terminals. An example of an offshore LNG import terminal is a floating storage and regasification unit (FSRU). An FSRU is a dedicated, moored offshore structure that transfers LNG from LNGCs, stores the LNG in storage tanks, regasifies the LNG using heat exchangers, and delivers the natural gas to a pipeline. An FSRU generally includes cryogenic cargo transfer equipment and LNG vaporization facilities, which may be located on the deck of the FSRU.

Further, offshore environmental conditions are a factor that limit the time periods that the LNGCs are able to offload LNG into an FSRU. For instance, harsh environmental conditions may provide periods of time where connecting the LNGCs and FSRU cannot be done safely and reliably. Further, if the offshore environmental conditions are too severe to allow the LNGCs and FSRU to connect, then the FSRU can only deliver natural gas to the pipeline from its stored reserves. Because of this, stored reserves on the FSRU may become depleted, leading to an interruption of natural gas delivery to the pipeline. Intermittent service or interruptions to the flow of natural gas into or from a pipeline may result in penalties and cost increases for companies operating the import or export terminals.

To address the environmental conditions, various offloading approaches are utilized to transfer LNG between LNGCs and FSRUs. For instance, one offloading approach is side-by-side offloading, which is currently employed at land-based import and export terminals. Side-by-side offloading may be performed with the LNGC and FSRU arranged in a side-by-side configuration with the LNG transfer occurring using marinized mechanical loading arms located near amidships of each LNGC and FSRU. Conventional land-based cargo transfer using mechanical loading arms is typically performed in protected waters.

A second offloading approach is tandem offloading. Tandem offloading of LNG parallels existing technology used to transfer oil between floating production storage and offloading (FPSO) vessels and shuttle tankers. Typically, the two vessels are arranged bow-to-stern with the cargo transfer achieved using flexible hoses. For LNG transfer, flexible cryogenic hoses or large loading arms, which are called booms, may be utilized with the LNGCs carrier bow located behind the stern of the FSRU. With these flexible cryogenic hoses or large loading arms, the tandem offloading approach may remain operable in more severe seastates than the side-by-side offloading approach.

A third offloading approach employs a subsea cryogenic fluid transfer system, which is described in International Patent Application No. W02006/044053. In this offloading approach, the LNGC and FSRU are connected over a distance of about 2 kilometers (km) by cryogenic turrets, risers and pipelines. The LNGC is connected to a submerged, disconnectable cryogenic buoy and transfers the LNG through this buoy and one or more flexible cryogenic risers to the seafloor, over to the FSRU location through one or more cryogenic pipelines, up one or more flexible cryogenic risers and into the FSRU through a cryogenic internal turret mooring system. Because the LNGC and FSRU are separated and may move independently, this offloading system may operate in extreme seastates, such as 4 to 5 meter significant wave heights.

While each of these offloading approaches may be utilized to maintain uniform delivery of natural gas to the pipeline, the use of FSRUs with any of these offloading approaches suffers from technical and commercial limitations. For instance, because FSRUs are permanently moored with no access to drydock maintenance, numerous upgrades are made to ensure that the facility remains operable over the project lifetime, which results in significant capital expenditure. Examples of these upgrades include additional hull steel for lengthening of fatigue life, improved hull coatings for corrosion resistance, and additional provisions for onsite inspections. This large initial capital expenditure results in a significant reduction in the overall LNG delivery chain economics. Also, additional equipment and operations, such as dedicated positioning tugs or navigation systems on the LNGCs, are involved to facilitate berthing operations for the LNGCs with the FSRU. While improved relative to onshore terminals, FSRUs still pose a security threat and have to be managed to address the open access provided in an offshore setting.

An alternate to the FSRU-based LNG import terminal is to include the regasification equipment on the LNGC. See U.S. Pat. No. 6,089,022. These vessels are LNGCs with extensive modifications to allow shipboard regasification of the LNG and offloading of the natural gas into the pipeline. These carriers, which may be referred to as Shipboard Regasification Terminals (SRTs), are equipped with regasification equipment and traditional LNGC offloading equipment (i.e. a manifold to accept loading arms) to interact with conventional LNG terminals. Disadvantageously, the capital expense of these SRTs may be greater than traditional LNGCs because each SRT vessel is modified with heat exchangers for regasification operations, a natural gas offloading system, and reinforced LNG cargo tanks to withstand sloshing loads. Because of these additional capital expenses, using only SRTs to deliver LNG tends to be uneconomic for long distances and/or large volumes. In addition, the LNG storage on the SRTs is somewhat limited because these vessels are designed for efficient transit over long distances.

As such, a method or mechanism for enhancing delivery of cargo, such as LNG, in an efficient manner is needed. This efficient method or mechanism may ideally alleviate the issues associated with operating offshore LNG import terminals.

Other related material may be found in at least U.S. Pat. No. 3,590,407; U.S. Pat. No. 5,501,625; U.S. Pat. No. 5,549,164; U.S. Pat. No. 6,003,603; U.S. Pat. No. 6,089,022; U.S. Pat. No. 6,637,479; U.S. Pat. No. 6,923,225; U.S. Pat. No. 7,080,673; U.S. Patent Application Publication No. 2002/0174662; U.S. Patent Application Publication No. 2004/0187385; U.S. Patent Application Publication No. 2006/0010911; European Patent Application No. 1,383,676; International Patent Application No. WO 01/03793; International Patent Application No. W02006/044053; Loez, Bernard "New Technical and Economic Aspects of LNG Terminals," Petrole Information, pp. 85-86, August 1987; Hans Y. S. Han et al., "Design Development of FSRU from LNG Carrier and FPSO Construction Experiences," Offshore Technology Conference May 6-9, 2002, OTC-14098; "The Application of the FSRU for LNG Imports," Annual GAP Europe Chapter Meeting Sep. 25-26, 2003; and O. B. Larsen et al., "The LNG (Liquefied Natural Gas) Shuttle and Regas Vessel System," Offshore Technology Conference May 3-6, 2004, OTC-16580.

SUMMARY

In one embodiment, a method for importing liquefied natural gas (LNG) is described. The method comprises providing a first import vessel operatively coupled to an import terminal, a second import vessel transporting LNG, and transport vessels, wherein each of the first import vessel and the second import vessel has regasification equipment, LNG offloading equipment, LNG storage tanks and natural gas transfer equipment to transfer natural gas from the first import vessel or the second import vessel to an import terminal; determining whether the first import vessel is to be replaced by the second import vessel; if the first import vessel is to be replaced by the second import vessel, decoupling the first import vessel from the import terminal, coupling the second import vessel to the import terminal and offloading LNG from transport vessels to the second import vessel; and if the first import vessel is to remain at the import terminal, offloading LNG from the second import vessel and from the transport vessels to the first import vessel. The importing of a carrier load may include offloading, receiving or otherwise transferring the carrier load, such as LNG, between two locations, which may include transporting the cargo load in international and/or territorial waters.

In another embodiment, a fluid transport system is described. The fluid transport system comprises at least one terminal; a plurality of transport vessels; and a plurality of regasification vessels. Each of the transport vessels has storage tanks and is configured to transport liquefied natural gas (LNG) in an open sea environment, while each of the regasification vessels is equipped regasification equipment, LNG offloading equipment, LNG storage tanks, and natural gas transfer equipment, and is configured to transport LNG in the open sea environment. One of the regasification vessels transports LNG in the open sea environment, while another of the regasification vessels is coupled to one of the at least one terminal to provide natural gas to the one of the at least one terminal from one of the transport vessels and the one of the regasification vessels. The regasification vessels may be configured to couple to the terminal; transfer the LNG from one of the transport vessels and another regasification vessel; regasify the LNG provided from one of the transport vessels and the other of the regasification vessels; and transfer the natural gas to the terminal.

In yet another embodiment, another method of transporting liquefied natural gas (LNG) is described. The method comprises providing a plurality of transport vessels having LNG storage tanks and configured to transport liquefied natural gas (LNG) in an open sea environment; and providing a plurality of regasification vessels, wherein each of the plurality of regasification vessels have regasification equipment, LNG offloading equipment, LNG storage tanks, equipment to transfer natural gas, and is configured to transport liquefied natural gas (LNG) in an open sea environment, and offloading LNG from one of the plurality of transport vessels by one of the plurality of regasification vessels at a first terminal concurrently while an other of the plurality of regasification vessels transports LNG in the open sea environment.

In still another embodiment, a method for transporting fluid is described. The method comprises coupling a first vessel to a terminal, wherein the first vessel has regasification equipment, offloading equipment, storage tanks, and equipment to transfer regasified fluid from the first vessel to the terminal; offloading the fluid to the first vessel from one of a plurality of transport vessels having storage tanks and a second vessel, wherein the second vessel has regasification equipment, offloading equipment, storage tanks, and equipment to transfer regasified fluid from the second vessel to the terminal; deberthing the first vessel from the terminal; berthing the second vessel adjacent to the terminal; coupling the second vessel to the terminal; offloading the fluid to the second vessel from one of the plurality of transport vessels and the first vessel. The fluid in the method may comprise liquefied natural gas, liquefied carbon dioxide, liquefied helium, and other suitable liquefied gases.

In addition, one or more embodiment may include other features. For instance, the methods may comprise regasifying the LNG on the first import vessel to deliver natural gas to a pipeline operatively coupled to the import terminal; wherein offloading LNG from transport vessels into the first import vessel comprises storing at least a portion of the LNG in the LNG storage tanks on the first import vessel; and wherein offloading LNG from transport vessels into the first import vessel comprises storing at least a portion of the LNG in LNG storage tanks associated with the terminal.

Further, one or more of the embodiments may include specific equipment. For instance, the regasification equipment may utilize one of an open-loop regasificiation system and closed-loop regasification system; may utilize sensible heat from another liquid as the heat source for the vaporization of the LNG; may utilize sensible heat from the combustion of a fuel as the heat source for the vaporization of the LNG; and/or may utilize latent heat from a condensable liquid as the heat source for the vaporization of the LNG. Also, the LNG offloading equipment may comprise cryogenic loading arms to transfer the LNG from the first import vessel and/or cryogenic hoses to transfer the LNG from the first import vessel. Also, the LNG may be offloaded by side-by-side offloading; tandem offloading; and/or subsea cryogenic fluid transfer system offloading. The LNG storage tanks may comprise spherical tanks, membrane tanks, self-supporting prismatic tanks, and/or modular tanks. The terminal may comprise two or more berthing structures, wherein the berthing structures comprises berthing dolphins fixed to the seafloor, a spread mooring system, submerged turret loading system, and any combination thereof.

BRIEF DESCRIPTION OF THE DRAWINGS

The foregoing and other advantages of the present invention may become apparent upon reading the following detailed description and upon reference to the drawings in which.

DETAILED DESCRIPTION

In the following detailed description and example, the invention will be described in connection with its preferred embodiments. However, to the extent that the following description is specific to a particular embodiment or a particular use of the invention, this is intended to be illustrative only. Accordingly, the invention is not limited to the specific embodiments described below, but rather, the invention includes all alternatives, modifications, and equivalents falling within the true scope of the appended claims.

At least some embodiments of the present invention are directed to methods and systems for transporting LNG via vessels between an export location and an import location. Under some embodiments of the present invention, SRTs, which are equipped with regasification equipment, LNG offloading equipment (e.g. marinized mechanical loading arms), LNG storage tanks, and equipment to transfer natural gas to the import terminal is utilized as temporary interchangeable FSRUs (TIFs). A first TIF, in conjunction with transport vessels (e.g. LNGCs), is utilized to transfer LNG between an export terminal and an import terminal. A second TIF is utilized in the system as a LNGC, carrying LNG between the export terminal and import terminal. Accordingly, the first TIF is temporarily moored at and in fluid communication with the import terminal and transfers LNG from the LNGCs (including the second TIF) into the TIF's LNG storage tanks. Concurrent with the LNG offloading operations, the first TIF is continuously regasifying the LNG from its LNG storage tanks and sending natural gas to the import terminal and ultimately to a pipeline. The first TIF may be replaced by the second TIF to maintain operations for the import terminal. The use of multiple TIFs in combination with LNGCs provides an alterative LNG delivery approach in comparison to having a permanently moored FSRU located at the import terminal or using a fleet of SRT vessels to transport LNG between an export terminal and an import terminal. Accordingly, the present invention may enhance delivery of LNG from one location to another location and may enhance importation of LNG at a particular location.

Figure 1:
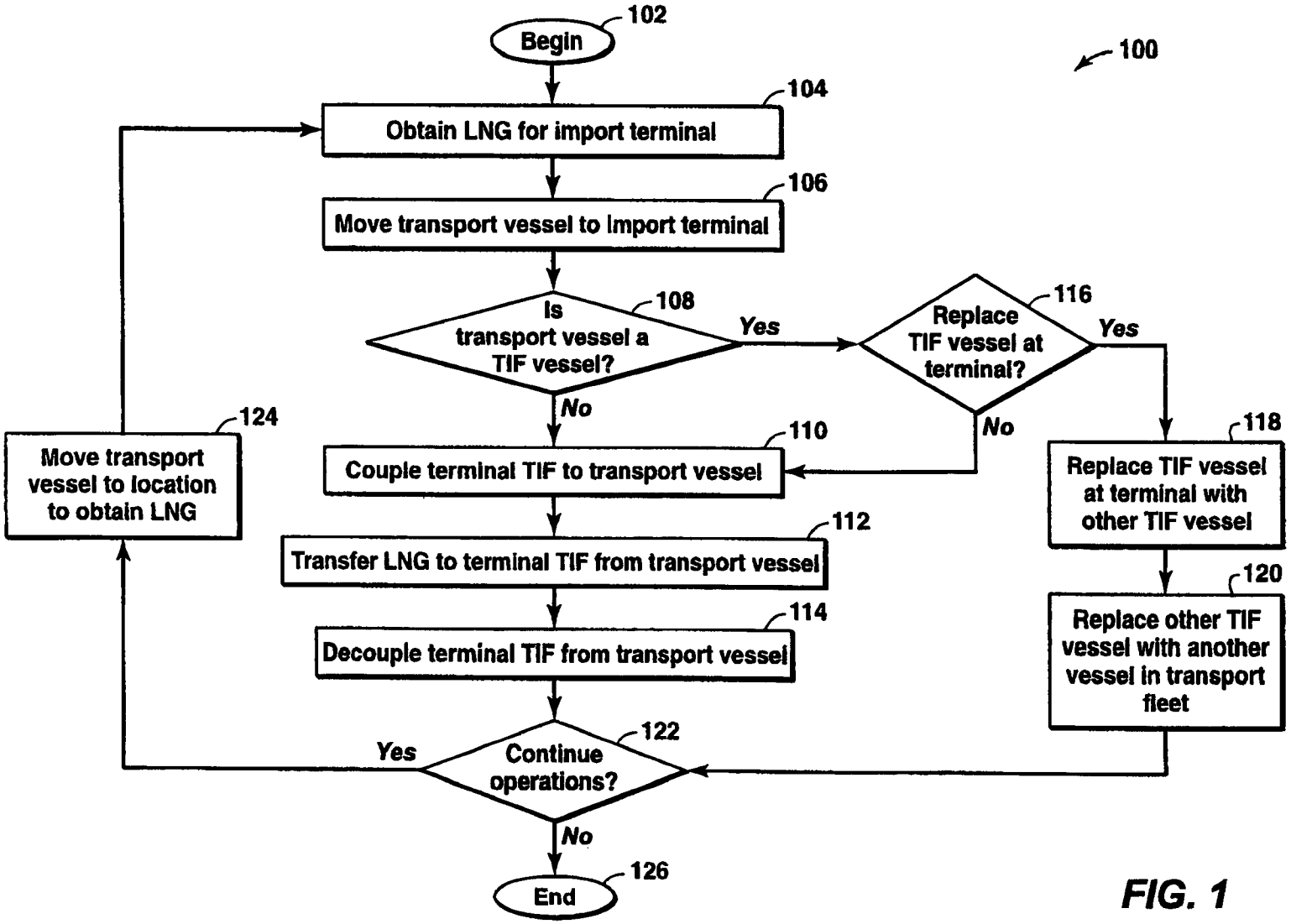
FIG. 1 is an exemplary flow chart of the LNG transfer operations in accordance with certain aspects of the present invention.

Turning now to the drawings, and referring initially to FIG. 1, an exemplary flow chart of fluid transfer operations in accordance with certain aspects of the present invention is illustrated. In the exemplary flow chart, which may be referred to by reference numeral 100, various operations may be performed to transfer fluids, such as LNG, from an export terminal to an import terminal. The transfer operations include the use of TIFs, which are vessels equipped with regasification equipment, LNG storage tanks, LNG offloading equipment (e.g. marinized mechanical loading arms), and equipment to transfer natural gas to the import terminal. The first TIF or TIF at the terminal interacts with transport vessels in the transport fleet, which include LNGCs and may include a second TIF. In particular, at least the first TIF is temporarily moored at and in fluid communication with an import terminal, while the second TIF or another TIF is utilized as a transport vessel in the transport fleet with one or more transport vessels. The use of these vessels is discussed further below.

The flow chart begins at block 102. At block 104, LNG is obtained by a transport vessel. The LNG may be obtained from the transfer of LNG from an export terminal, such as an onshore or offshore LNG plant, which is designed to receive, process, and liquefy natural gas. The transport vessel fleet may include vessels, such LNGCs and at least one TIF, which are configured to transport LNG across the open sea. The open sea refers to any division of a large body of water, which may include bays, lakes, seas, oceans, gulfs or the like. The open sea may include territorial waters or international waters, as well. At block 106, the transport vessel is moved toward an import terminal, such as an onshore or offshore import terminal designed to receive and regasify LNG for sendout as natural gas through a pipeline to a market location.

Then, a determination is made whether the approaching transport vessel is a TIF, as shown in block 108. If the transport vessel is not a TIF, the transport vessel is moored to the first TIF, which is temporarily moored at and in fluid communication with the import terminal, as shown at block 110. The first TIF or TIF at the terminal may be moored at the import terminal and operated to receive LNG from the transport vessels in the transport fleet. The transport vessel is moored to the first TIF in an appropriate offloading configuration, while the LNG offloading equipment is prepared for offloading operations. At block 112, the LNG is transferred from the transport vessel to the first TIF. The transfer of LNG between vessels may be performed by side-by-side offloading, tandem offloading, or by utilizing a subsea LNG transfer system (SLTS). Once LNG offloading operations are complete, the transport vessel departs from the first TIF, as shown in block 114. The departure of the transport vessel from the first TIF may include preparing the fluid transfer equipment and mooring lines for disconnection, and moving the transfer vessel away from the import terminal.

However, if the transport vessel is the other or second TIF, then a determination is made whether to replace the first TIF currently temporarily moored at and in fluid communication with the import terminal, as shown in block 116. The first TIF at the import terminal may be replaced if it is scheduled for maintenance that requires drydocking, if the first TIF is notified a second TIF is approaching, or based on procedures for the import terminal. If the first TIF at the import terminal is not replaced, then the transfer of LNG from the second TIF to the first TIF may be performed in a similar manner to the transfer of LNG from transport vessels, as shown in block 110. However, if the first TIF at the import terminal is to be replaced, the second TIF may replace the first TIF in block 118. The replacement of the first TIF at the import terminal with the second TIF may include mooring the second TIF at the import terminal, preparing the regasification equipment on the second TIF to begin delivery of regasified LNG, beginning delivery of natural gas to the pipeline from the second TIF, preparing the regasification equipment on the first TIF to stop delivery of regasified LNG, stopping delivery of natural gas to the pipeline from the first TIF, and departure of the first TIF from the import terminal. Further, the first TIF and second TIF may be used at the import terminal concurrently to handle additional LNG transfers in some embodiments. At block 120, the other TIF may be replaced by another transport vessel to maintain capacity in the transport fleet. The other transport vessel may be the first TIF that was replaced at the import terminal, another chartered LNGC, or some other suitable vessel.

Then, a determination is made whether operations are to continue in block 122. This may include determining to continue importing LNG at the import terminal. If operations continue, the transport vessel may be moved to receive additional LNG at block 124. In this manner, the shipment of LNG to the import terminal may continue. However, if the operations are not to continue, the process ends at block 126.

Beneficially, the use of the present invention may enhance the transfer of cargo, such as LNG, over other techniques from a commercial perspective. For instance, the present invention limit the permanent equipment (e.g. structures, regasification equipment, and LNG storage tanks) installed at the import terminal. That is, two or more TIFs may be utilized with a first TIF at the terminal to receive LNG and a second TIF being part of the transport fleet with other LNGCs. In this configuration, the overall cost of an offshore LNG import terminal may be reduced by the use of two or more TIFs, which may be less expensive than a permanent installation because of the ability to build and maintain (e.g. their ability to enable drydocking) these vessels with the efficiencies associated with shipyard fabrication. By utilizing a limited amount of permanently installed equipment, issues with permitting and concerns about public opposition may also be alleviated. Further, because of the limited amount of permanently installed equipment, flexibility of market supply may be achieved by installing numerous import terminals for the TIFs to choose from within a given region.

Figure 2:
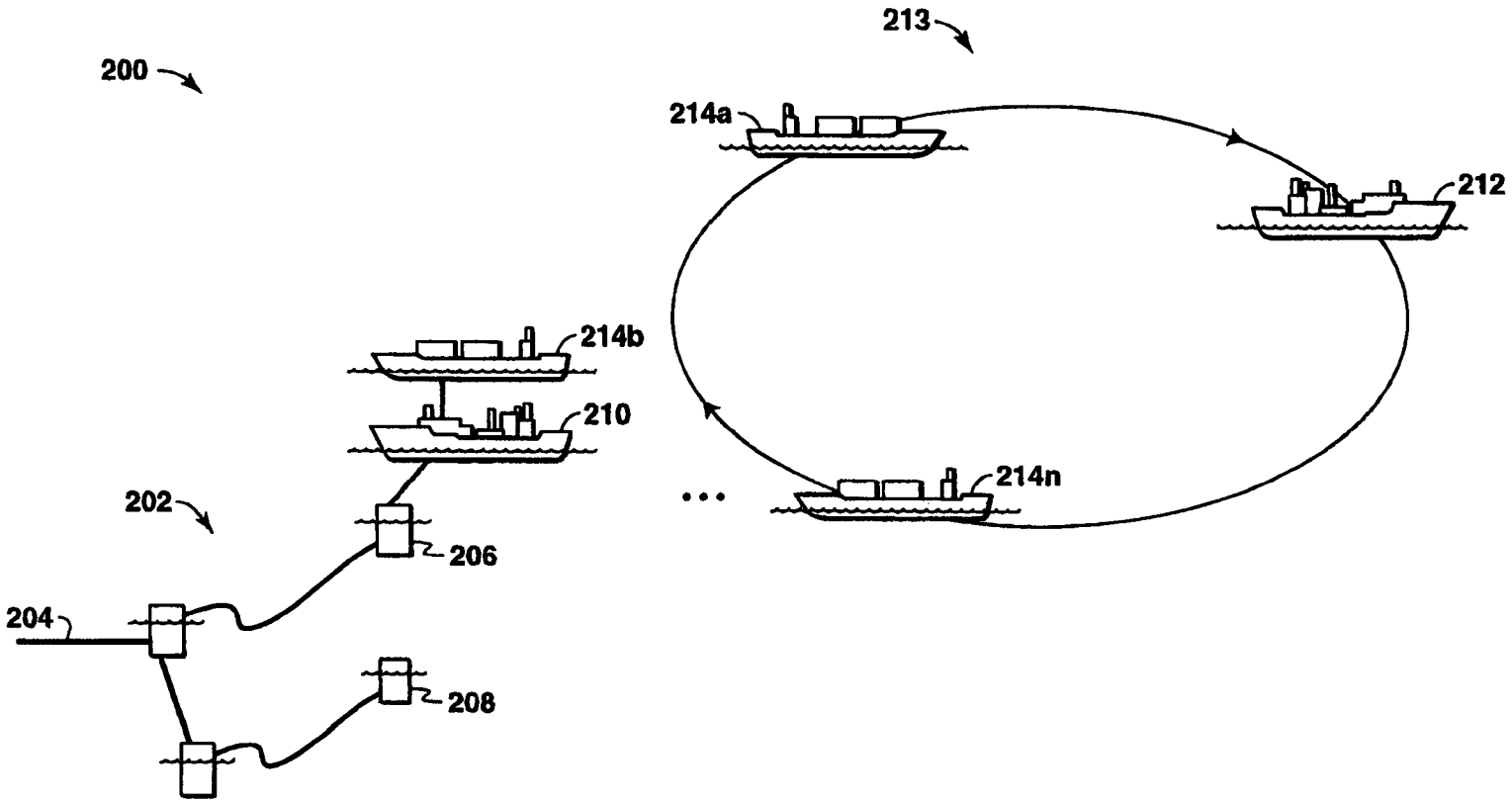
FIG. 2 is an exemplary fluid transport system or fleet in accordance with certain aspects of the present invention.

Exemplary embodiments of the above described process are discussed below. For instance, FIG. 2 is an exemplary fluid transport system or fleet 200 in accordance with certain aspects of the present invention. In the exemplary fluid transport system 200, an import terminal 202, which is in fluid communication with a pipeline 204, may be positioned at an offshore location. The pipeline 204 may receive natural gas or vaporized LNG from TIFs 210 and/or 212, which are LNGC-based vessels functioning as FSRUs. One of the TIFs, such as the first TIF 210 may be temporarily moored at and in fluid communication with the import terminal 202, while the other TIF, such as the second TIF 212, is concurrently utilized as a transport vessel in the transport fleet 213. The first TIF 210 may receive LNG from transport vessels 214*a*-214*n* and the second TIF 212, convert the LNG into natural gas with the regasification equipment on the first TIF 210 and provide the natural gas to the import terminal 202 and ultimately to the pipeline 204. In this manner, the first TIF 210 may be replaced by the second TIF 212, which is part of the transport fleet 213, when maintenance is required or based on specific procedures. Beneficially, the TIFs 210 and 212 enhance transfer operations over existing procedures, while also reducing costs and limitations of the existing permanent import terminal designs.

The import terminal 202 may include various mechanisms for mooring one or more TIFs 210 and 212. For instance, the import terminal 202 may include two or more Submerged Turret Loading (STL) offloading buoys, such as a first buoy 206 and a second buoy 208, which may be fixed to the seafloor in an open sea environment to provide a berth for the TIFs. Other methods of mooring one or more TIFs 210 and 212 include single point mooring systems, such as a Catenary Anchor Leg Mooring (CALM) system, a Jacket Soft Yoke (JSY) system, a Fixed Tower Single Point Mooring (FTSPM) system, and/or a Single Anchor Leg Mooring (SALM) system. It should be noted that the import terminal 202 may also be any offshore structure known in the art, which may have one or more berths for mooring one or more TIFs 210 and 212.

There are various ways for the import terminal 202 to be in fluid communication with the pipeline 204. For instance, the import terminal 202 may include two or more STL offloading buoys, such as the first buoy 206 and the second buoy 208, to sendout the natural gas through one or more dynamic flexible risers, a pipeline end manifold (PLEM) and to the pipeline 204. The pipeline 204 is configured to receive natural gas and transfer the natural gas to onshore facilities (not shown). Other mechanisms for gas sendout (e.g. used in conjunction with aforementioned mooring systems) include hard pipe systems incorporating high-pressure gas swivels and/or high-pressure gas hoses either suspended in the air or floating in the water. It should be noted that any mechanism in the current art allowing gas sendout to the pipeline 204 may be used.

To provide the LNG to the import terminal 202, the LNGCs 214*a*-214*n* and one of the TIFs 210 and 212 may travel across the open sea to an export terminal. Accordingly, the TIFs 210 and 212 and LNGCs 214*a*-214*n* may be equipped with typical systems for propulsion and navigation along with accommodations for marine operations and LNG storage tanks, which are used for open sea transport of LNG. The LNG storage tanks may include various types of tank designs, such as spherical, membrane, self-supporting prismatic (SPB), or rectangular (modular) tanks, which are suitable for storing LNG. In addition, the TIFs 210 and 212 and LNGCs 214*a*-214*n* may include ancillary systems, such as living quarters and maintenance facilities, safety systems, emergency escape and evacuation systems, logistics systems, power generation and other utilities to support operations. As noted above, while each of the TIFs 210 and 212 and LNGCs 214*a*-214*n* include LNG storage tanks and other typical equipment, the TIFs 210 and 212 may also include regasification equipment, LNG offloading equipment, and equipment for transfer of natural gas to the import terminal 202 and ultimately to the pipeline 204. The regasification equipment may include any of a variety of conventional types of equipment that are combined to make up a regasification system in an onshore LNG import terminal, such as pumps, vessels and heat exchangers. The regasification system may be an open-loop or closed-loop system, and may utilize any number of heat sources, including sensible heat in seawater, sensible heat from the combustion of fuels, latent heat from a condensable liquid, or other heat sources that are known in the art. The LNG offloading equipment may include cryogenic loading arms, cryogenic hoses or other equipment utilized in the transfer of LNG. In particular, the cryogenic loading arms and cryogenic hoses may be designed to accommodate LNG carrier motions in the offshore environment during offloading operations, such as connection, LNG transfer and disconnection. The equipment for transfer of natural gas to the import terminal 202 may include mechanical hard arms which are upgraded for high-pressure gas sendout, a compartment within the vessel's hull for receiving a system such as an STL buoy, bow modifications for high-pressure gas transfer to a tower-toke mooring system, or other means for transfer of natural gas as is known in the art. As a specific example, each of the TIFs 210 and 212 may be LNGC-based vessels having five membrane storage tanks that provide 265,000 cubic meters ($m^3$) of total LNG storage, an open-loop regasification system utilizing seawater providing 1.0 billion standard cubic feet per day (BScf/d), marinized mechanical hard arms for LNG offloading, and a compartment integrated into the vessel's hull to accept an STL buoy that allows both mooring at the import terminal 202 and send out of natural gas to the import terminal 202 and ultimately to the pipeline 204.

As a specific, non-limiting example of the operation, the first TIF 210 may be temporarily moored at and in fluid communication with the import terminal 202, while the second TIF 212 is utilized as a transport vessel in the transport fleet. That is, the first TIF 210 may be in fluid communication with the pipeline 204 through the import terminal 202, while the second TIF 212 functions in a manner similar to the LNGCs 214*a*-214*n*. In this configuration, the LNG cargo is transferred from one of the second TIF 212 and LNGCs 214*a*-214*n* to the first TIF 210, which is temporarily moored at and in fluid communication with the import terminal 202, through the offloading approaches discussed above. Once the first TIF 210 requires maintenance (e.g. drydocking), the second or other TIF 212, which is part of the transport fleet 213, may replace the first TIF 210, or temporarily moor at and be in fluid communication with the STL buoy 208. Another LNGC may be chartered to replace the second TIF 212 in the transport fleet 213 or the first TIF 210 may join the transport fleet 213.

Beneficially, the use of multiple TIFs for an import terminal provides an inexpensive alternative to permanent facilities because of the efficiencies associated with shipyard fabrication, rather than a custom built permanent installation. Additionally, because one of the TIFs is acting as a transport vessel, the capital expense for a single LNGC in the transport fleet is eliminated, again reducing the overall expenditure. Also, the import terminal may be scalable through the use of three or more TIFs and two or more import terminals, as is shown in greater detail in FIG. 3.

Figure 3:
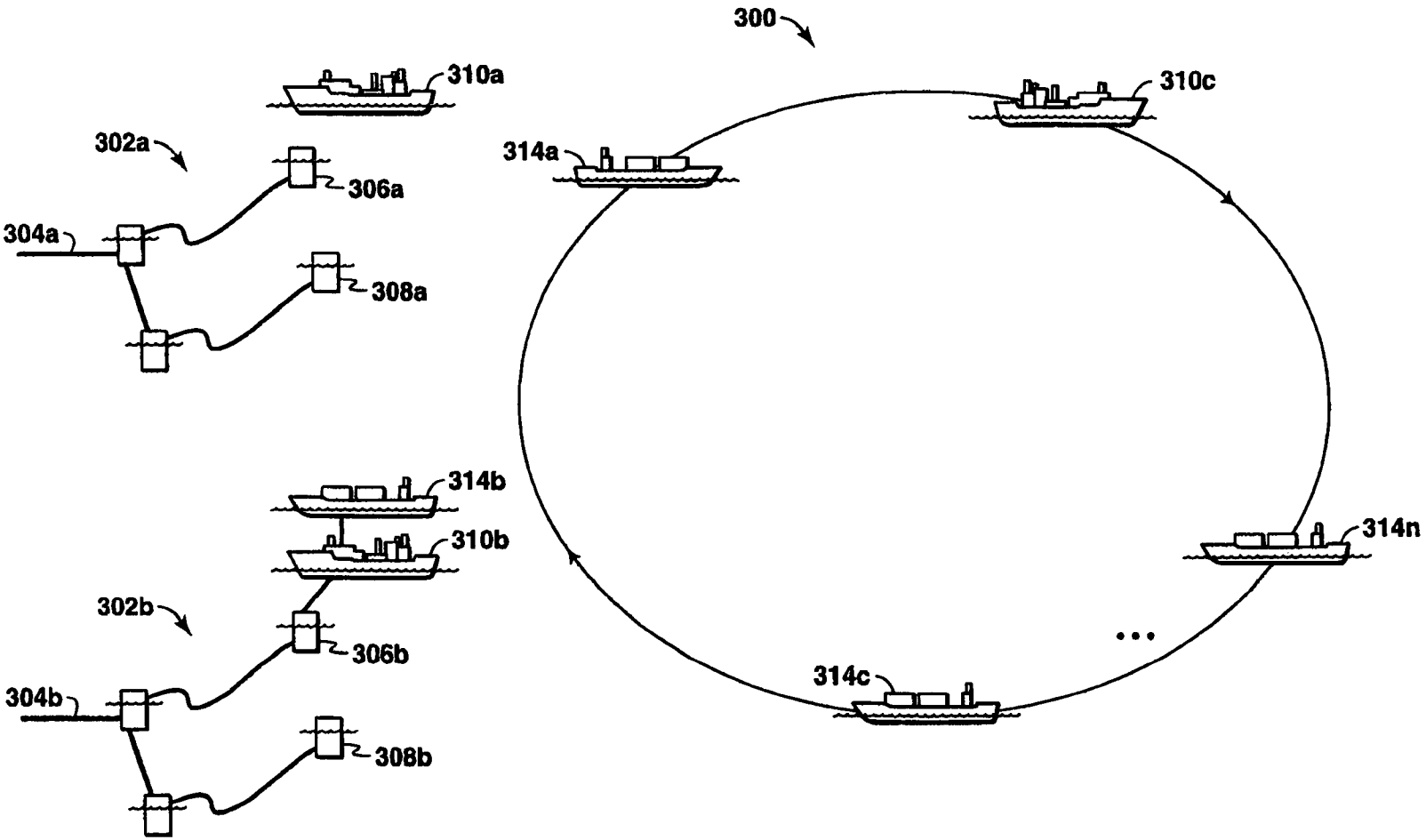
FIG. 3 is another exemplary fluid transport system or fleet in accordance with certain aspects of the present invention.

FIG. 3 is another exemplary fluid transport system or fleet 300 in accordance with certain aspects of the present invention. In the exemplary fluid transport system 300, multiple import terminals 302*a* and 302*b* may be offshore import terminals similar to the import terminal 202, which have submerged turret loading (STL) buoys 306*a*, 306*b*, 308*a* and 308*b*. The import terminals 302*a* and 302*b* may each be coupled to a pipeline 304*a* and 304*b* to provide natural gas from one or more of the TIFs 310*a*-310*c*, such as the first and second TIFs 310*a* and 310*b*. The first and second TIFs 310*a* and 310*b* may receive LNG from the third TIF 310*c* or one of the LNGCs 314*a*-314*n*, which are similar to the LNGCs 210 and 212 of FIG. 2. Then, the LNG from one of the LNGCs 314*a*-314*n* or third TIF 310*c* may be regasified and transferred to the respective pipeline 304*a* and 304*b* by the associated first and second TIF 310*a* and 310*b* and one of the import terminals 302*a* and 302*b*. The selection of the import terminal 302*a* or 302*b* may be based on the terminal having the highest demand or offering the best price. In one preferred embodiment, there is one more TIF than there are import terminals. However, it should be noted that the number of TIFs and import terminals may be any integer number based on a specific configuration.

As another non-limiting example, a first TIF 310*a* is temporarily moored at and in fluid communication with the first import terminal 302*a*, and offloads LNG from a first LNGC 314*a*. The first TIF 310*a* regasifies the LNG and sends this natural gas to the first pipeline 304*a* through the first import terminal 302*a*. Once the first LNGC 314*a* completes the LNG offloading process with the first TIF 310*a*, it departs from the first import terminal 302*a* and travels to an export terminal to receive additional LNG. Concurrent with the operations at the first import terminal 302*a*, a second TIF 310*b* is temporarily moored at and in fluid communication with the second import terminal 302*b*. The second TIF 310*b* offloads LNG from a second LNGC 314*b*. The second TIF 310*b* regasifies the LNG and sends this natural gas to the second pipeline 304*b* through the second import terminal 302*b*. In this configuration, the selection of import terminals 302*a* and 302*b* for LNG offloading from LNGCs 314*a*-314*n* may be based upon environmental conditions (e.g. weather or waves at one of the import terminals) or even commercial conditions (e.g. locations relative to best market, contractual obligations, etc.). Further, the import terminals 302*a* and 302*b* may both be located in the same location for the sole purpose of providing double the volumes of natural gas to the market that a single import terminal could supply.

In addition to providing flexibility in the selection of import terminals for the LNG, the process provides flexibility for selecting import terminals based on the replacement of an existing TIF operating at the terminal. That is, a third TIF 310*c*, which is part of the transport fleet 300, may select an import terminal 302*a* or 302*b*, as it travels across the open sea. The selection may be based on one of the TIFs 310*a* or 310*b* needing service or needing to be replaced for operations. The existing TIF 310*a* or 310*b* may depart from their respective import terminals. Then, the TIF 310*a* or 310*b* may join the transport fleet by traveling to the export terminal to receive LNG or travel to receive maintenance at a drydock. In fact, some maintenance performed on the TIF may even be performed as it is traveling to receive a shipment of LNG from an export terminal. As such, the use of the multiple TIFs may enhance transport operations for LNG.

Beneficially, the present invention are scalable with the installation of two or more import terminals 302*a* and 302*b* and three or more TIFs 310*a*-310*c*. By standardizing the methods of mooring the TIFs at and transferring the natural gas to the import terminals (e.g. utilizing STL buoys), the TIFs 310*a*-310*c* may relocate between different import terminal locations 302*a* and 302*b* in response to market forces and local gas prices. Further, where multiple import terminals are in operation with TIFs, a single additional TIF may serve as the replacement TIF for multiple terminals. This affords an additional cost saving benefit compared to operations with a single import terminal by "sharing" the cost of the replacement TIF among many projects.

Further, it should be noted that other fluid cargos may be transferred instead of LNG. For instance, the cargo may include $CO_2$, He, or other gases that may be converted into a liquid at certain temperatures and pressures. Similar to the systems and methods discussed above, two or more vessels may include special hardware to manage the transfer of cargo and regasification of the fluid cargo to a pipeline. For instance, a first vessel may be operatively coupled to a terminal, wherein the first vessel has regasification equipment, offloading equipment, storage tanks, and equipment to transfer regasified fluid from the first vessel to the terminal. Then, a fluid may be offloaded to the first vessel from one of one or more transport vessels having storage tanks and a second vessel having regasification equipment, offloading equipment, storage tanks, and equipment to transfer regasified fluid from the second vessel to the terminal. The first vessel may deberth from the terminal, before or concurrently with the berthing and coupling of the second vessel to the terminal. Then, the fluid may be offloaded to the second vessel from one of the transport vessels and the first vessel.

While the present invention may be susceptible to various modifications and alternative forms, the exemplary embodiments discussed above have been shown by way of example. However, it should again be understood that the invention is not intended to be limited to the particular embodiments disclosed herein. Indeed, the present invention covers all modifications, equivalents, and alternatives falling within the spirit and scope of the invention as defined by the following appended claims.

What is claimed is:

1. A method for importing liquefied natural gas (LNG) comprising the steps of:

first: providing a first import vessel operatively coupled to an import terminal, a second import vessel transporting LNG, and transport vessels, wherein each of the first import vessel and the second import vessel has regasification equipment, LNG offloading equipment, LNG storage tanks and natural gas transfer equipment to transfer natural gas from the first import vessel or the second import vessel to the import terminal, wherein the first import vessel, the second import vessel and the transport vessels are separate from one another;

second: determining whether the second import vessel or one of the transport vessels is approaching the first import vessel;

third:

if the second import vessel is approaching the first import vessel, determining whether the second import vessel is to replace the first import vessel;

if the first import vessel is to be replaced by the second import vessel, decoupling the first import vessel from the import terminal, coupling the second import vessel to the import terminal and offloading LNG from the transport vessels to the second import vessel;

if the first import vessel is to remain at the import terminal, offloading LNG from the second import vessel to the first import vessel; and if one of the transport vessels is approaching the first import vessel, coupling the first import vessel to the one of the transport vessels and offloading LNG from the one of the transport vessels to the first import vessel;

fourth: regasifying the LNG on the first import vessel to deliver natural gas to a pipeline operatively coupled to the import terminal, wherein the regasification equipment utilizes one of an open-loop regasificiation system and a closed-loop regasification system, offloading LNG comprises storing at least a portion of the LNG in LNG storage tanks associated with the import terminal, and offloading LNG from transport vessels into the second import vessel comprises side-by-side offloading.

2. The method of claim 1, wherein the regasification equipment utilizes sensible heat from another liquid as a heat source for vaporization of the LNG.

3. The method of claim 1, wherein the regasification equipment utilizes sensible heat from combustion of a fuel as a heat source for vaporization of the LNG.

4. The method of claim 1, wherein the regasification equipment utilizes latent heat from a condensable liquid as a heat source for vaporization of the LNG.

5. The method of claim 1, wherein the LNG offloading equipment comprises cryogenic loading arms to transfer the LNG from the first import vessel.

6. The method of claim 1, wherein the LNG offloading equipment comprises cryogenic hoses to transfer the LNG from the first import vessel.

7. The method of claim 1, wherein offloading LNG from transport vessels into the second import vessel comprises tandem offloading.

8. The method of claim 1, wherein offloading LNG from transport vessels into the second import vessel comprises subsea cryogenic fluid transfer system offloading.

9. The method of claim 1, wherein the LNG storage tanks comprise spherical tanks.

10. The method of claim 1, wherein the LNG storage tanks comprise membrane tanks.

11. The method of claim 1, wherein the LNG storage tanks comprise self-supporting prismatic tanks.

12. The method of claim 1, wherein the LNG storage tanks comprise modular tanks.

13. A method for transporting fluid comprising carbon dioxide or helium comprising the steps of:

first, coupling a first vessel to a terminal, wherein the first vessel has regasification equipment, offloading equipment, storage tanks for the fluid being transported, and equipment to transfer regasified fluid from the first vessel to the terminal;

second, offloading the fluid to the first vessel from one of a plurality of transport vessels having storage tanks and a second vessel, wherein the second vessel has regasification equipment, offloading equipment, storage tanks for the fluid being transported, and equipment to transfer regasified fluid from the second vessel to the terminal;

third, deberthing the first vessel from the terminal;

fourth, berthing the second vessel adjacent to the terminal;

fifth, coupling the second vessel to the terminal, wherein the first vessel is deberthed from the terminal one of before and concurrently with the berthing and coupling of the second vessel to the terminal; and sixth, offloading the fluid to the second vessel from one of the plurality of transport vessels and the first vessel, wherein offloading LNG from transport vessels into the second import vessel comprises side-by-side offloading.

* * * * *